US010753371B2

(12) United States Patent
Sebrecht et al.

(10) Patent No.: US 10,753,371 B2
(45) Date of Patent: Aug. 25, 2020

(54) STAGE OF VARIABLE-PITCH BLADES FOR A TURBINE ENGINE, TURBINE ENGINE AND ASSOCIATED INSTALLATION METHOD

(71) Applicant: SAFRAN AIRCRAFT ENGINES, Paris (FR)

(72) Inventors: Pierre-Alain Francis Claude Sebrecht, Moissy-Cramayel (FR); Damien Joseph Cellier, Moissy-Cramayel (FR); Cédric Michel Claude Chretien, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 15/745,690

(22) PCT Filed: Jul. 11, 2016

(86) PCT No.: PCT/FR2016/051766
§ 371 (c)(1),
(2) Date: Jan. 17, 2018

(87) PCT Pub. No.: WO2017/013326
PCT Pub. Date: Jan. 26, 2017

(65) Prior Publication Data

US 2018/0209444 A1 Jul. 26, 2018

(30) Foreign Application Priority Data

Jul. 20, 2015 (FR) ..... 15 56833

(51) Int. Cl.
*F01D 17/16* (2006.01)
*F04D 29/56* (2006.01)
(Continued)

(52) U.S. Cl.
CPC ..... *F04D 29/563* (2013.01); *F01D 17/162* (2013.01); *F04D 29/056* (2013.01);
(Continued)

(58) Field of Classification Search
CPC ..... F01D 17/16; F01D 17/162; F04D 29/56; F04D 29/563; F04D 29/056;
(Continued)

(56) References Cited

U.S. PATENT DOCUMENTS 3,695,777 A * 10/1972 Westphal ..... F01D 17/162 415/147
3,788,763 A * 1/1974 Nickles ..... F01D 17/162 415/147
(Continued)

FOREIGN PATENT DOCUMENTS

EP 1 500 791 A1 1/2005
FR 2 890 707 A1 3/2007
GB 1 409 502 A 10/1975

OTHER PUBLICATIONS

Written Opinion dated Sep. 29, 2016, for International Application No. PCT/FR2016/051766, filed Jul. 11, 2016, 4 pages.
(Continued)

*Primary Examiner* — Richard A Edgar
(74) *Attorney, Agent, or Firm* — Christensen O'Connor Johnson Kindness PLLC

(57) ABSTRACT

A stage of variable-pitch vanes for a turbine engine includes a plurality of vanes. Each vane has a blade with a first radially internal frusto-conical surface. The cone angle of the first frusto-conical surface is radially flared inwards and is configured to interact with an internal frusto-conical surface of a first frusto-conical bushing. The vane further includes a second radially external frusto-conical surface with cone angle that is radially flared outwards and is
(Continued)

configured to interact with an internal frusto-conical surface of a second substantially frusto-conical bushing.

8 Claims, 3 Drawing Sheets

(51) Int. Cl.
*F04D 29/056* (2006.01)
*F04D 29/64* (2006.01)
*F04D 29/08* (2006.01)

(52) U.S. Cl.
CPC ..... *F04D 29/644* (2013.01); *F04D 29/083* (2013.01); *F05D 2220/323* (2013.01); *F05D 2220/3219* (2013.01); *F05D 2240/129* (2013.01); *F05D 2240/50* (2013.01); *F05D 2250/232* (2013.01)

(58) Field of Classification Search
CPC ..... F04D 29/644; F04D 29/083; F05D 2220/3219; F05D 2220/323; F05D 2240/129; F05D 2240/50; F05D 2250/232
See application file for complete search history.

(56) References Cited

U.S. PATENT DOCUMENTS

| | | | | |
|---|---|---|---|---|
| 7,214,030 | B2 | 5/2007 | Arilla et al. | |
| 7,588,416 | B2 | 9/2009 | Bouru | |
| 2011/0176913 | A1* | 7/2011 | Wassynger ..... | F01D 17/162 415/159 |

OTHER PUBLICATIONS

International Preliminary Report on Patentability dated Jan. 23, 2018, issued in corresponding International Application No. PCT/FR2016/051766, filed Jul. 11, 2016, 1 page.
International Search Report dated Sep. 29, 2016, for International Application No. PCT/FR2016/051766, filed Jul. 11, 2016, 6 pages.
Written Opinion dated Sep. 29, 2016, for International Application No. PCT/FR2016/051766, filed Jul. 11, 2016, 5 pages.

* cited by examiner

STAGE OF VARIABLE-PITCH BLADES FOR A TURBINE ENGINE, TURBINE ENGINE AND ASSOCIATED INSTALLATION METHOD

TECHNICAL FIELD

The present invention relates to a stage of variable-pitch vanes for a turbine engine.

PRIOR ART

The prior art comprises in particular FR-B1-2 885 968, FR-A1-2 928 979, WO-A1-2009/133297, FR-A1-2 874 977, FR-A1-2 892 147 and FR-A1-2 890 707.

The variable stator vanes (VSV) of a turbine engine are supported by an external annular casing, generally of a compressor of the turbine engine. Each vane comprises a blade that is connected at its radially external end to a radial cylindrical pivot that defines the axis of rotation of the vane and is rotationally guided in a corresponding chamber of the external casing. The radially internal end of the blade of each vane generally comprises a second cylindrical pivot extending along the axis of rotation of the vane and being rotationally guided in an opening in an internal casing of the compressor.

The radially external end of the external pivot of each vane is connected by a lever to a control ring that is rotated about the external casing by actuating cylinder or similar actuation means. The rotation of the control ring is transferred by the levers to the external pivots of the vanes and causes them to rotate about their axes.

The angular pitch of the stator vanes in a turbine engine is suitable for adapting the geometry of the compressor to its operating point and in particular to optimise the efficiency and the surge margin of this turbine engine and to reduce its fuel consumption in the various flight configurations.

Each of these vanes can rotate about its axis between a first "open" or "full open" position, in which each vane extends substantially in parallel with the longitudinal axis of the turbine engine, and a second "closed" or "almost closed" position, in which the vanes are inclined relative to the axis of the turbine engine and thus reduce the cross section of airflow through the vane stage.

In the current state of the art, the radially external pivot of each vane is cylindrical and is centred and guided in rotation in the corresponding chamber of the external casing by cylindrical bushings. A first bushing is mounted at the radially internal end of the pivot and can comprise an external annular rim interposed between the blade and the casing, and a second bushing is mounted at the radially external end of the pivot and can also comprise an external annular rim interposed between the casing and the aforementioned lever.

Due to the manufacturing tolerances, and in order to allow the external pivot of the vane to be mounted in the chamber of the casing, the bushings and the pivot are mounted in the chamber with clearances. These clearances are a source of air leaks, which alter the performance of the turbine engine. Furthermore, during operation, the friction forces between the pivot and the bushings can generate wear in the bushings and increase the aforementioned clearances, and thus the air leaks.

The present invention proposes a solution to this problem that is simple, effective and economical.

DISCLOSURE OF THE INVENTION

The invention proposes a stage of variable-pitch vanes for a turbine engine, comprising an annular casing having an axis of revolution A and an annular row of vanes extending about said axis A and inside the casing, each vane comprising a substantially radial blade comprising a cylindrical pivot at each of its radial ends, the radially external pivot of each vane being mounted in a radial chamber of the casing and being centred and guided in this chamber by means of bushings, characterised in that the radially external pivot of each vane comprises:

a first radially internal frusto-conical surface, the cone angle of which is radially flared inwards and which is designed to interact with an internal frusto-conical surface of a first substantially frusto-conical bushing; and a second radially external frusto-conical surface, the cone angle of which is radially flared outwards and which is designed to interact with an internal frusto-conical surface of a second substantially frusto-conical bushing.

The interaction of the frusto-conical surfaces of the external pivot of each vane with the frusto-conical surfaces of the bushings allows a seal to be provided between the pivot and the bushings, even if clearances must be provided between these elements for mounting. This interaction has the further advantage of not being affected by the wear of the bushings, as will be explained in detail hereafter.

The stage according to the invention can comprise one or more of the following features, taken separately or in combination:

said first and second frusto-conical surfaces are connected together by a cylindrical surface of the pivot;

said first bushing comprises an external frusto-conical surface designed to interact with an internal frusto-conical surface of the chamber of the casing, and/or said second bushing comprises an external frusto-conical surface designed to interact with an internal frusto-conical surface of the chamber of the casing;

each of said first and second bushings comprises a cylindrical or radial rim;

the closest radial distance between said first and second frusto-conical surfaces of the pivot is greater than the closest radial distance between the internal frusto-conical surfaces of said first and second bushings; and the first frusto-conical surface of the pivot is defined by a radially internal frusto-conical part of the pivot, which part is integrally formed with the pivot, and the second frusto-conical surface of the pivot is defined by an internally threaded ring designed to be screwed onto an externally threaded radially external frusto-conical part of the pivot.

The present invention further relates to a turbine engine for aircraft, comprising at least one stage as described above.

The present invention further relates to a method for mounting a stage as described above, said method comprising the following steps, including, for each vane:

mounting said first and second bushings in the chamber of the casing;

positioning the vane in the casing and inserting its radially external pivot into the corresponding chamber of the casing, by radially moving said pivot from the inside to the outside, until the first frusto-conical surface of the pivot comes into abutment on the internal frusto-conical surface of the first bushing;

placing the ring on the pivot and screwing it onto the externally threaded part of the pivot, until a desired distance is obtained between said first and second frusto-conical surfaces.

After screwing, the second frusto-conical surface defined by the ring is preferably radially spaced apart from the internal frusto-conical surface of the second bushing. A clearance is thus deliberately maintained between the ring and the second bushing. Indeed, any tightening between these elements is preferably avoided in order to allow and to facilitate the pivoting of the vane.

It is thus understood that the radially external frusto-conical surface of the pivot is not in abutment on the frusto-conical surface of the second bushing when the radially internal frusto-conical surface of the pivot is in abutment on the frusto-conical surface of the first bushing, and vice versa. The first case (the radially external frusto-conical surface of the pivot is not in abutment on the frusto-conical surface of the second bushing) occurs when the prevailing pressure in the duct, on the radially external end (such as the external plate) of the vane, is greater than that on its radially internal end (internal plate). The pressure is always greater inside the casing than outside the casing. However, the pressure can vary along the radial height of the vane. Therefore, if the pressure at the root of the vane is greater than at the head, the pressure applied to the internal plate will tend to bring the vane radially together with the axis of the turbine engine and contact will be made with the second bushing (external). Contact will be made with the first bushing (internal) if there is greater pressure at the head than at the root of the vane. The vanes are then radially stressed outwards and the radially internal frusto-conical surfaces of their pivots come into abutment on the first bushings. The second case (the radially external frusto-conical surface of the pivot is in abutment on the frusto-conical surface of the second bushing) occurs when the prevailing pressure in the duct, on the external plate of the vane, is less than the pressure on its internal plate. The vanes are then radially stressed inwards and the radially external frusto-conical surfaces of their pivots come into abutment on the second bushings.

DESCRIPTION OF THE DRAWINGS

The invention will be better understood, and further details, features and advantages of the invention will become more clearly apparent, upon reading the following description, which is provided by way of a non-limiting example, and with reference to the accompanying drawings, in which.

DETAILED DESCRIPTION

Figure 1:
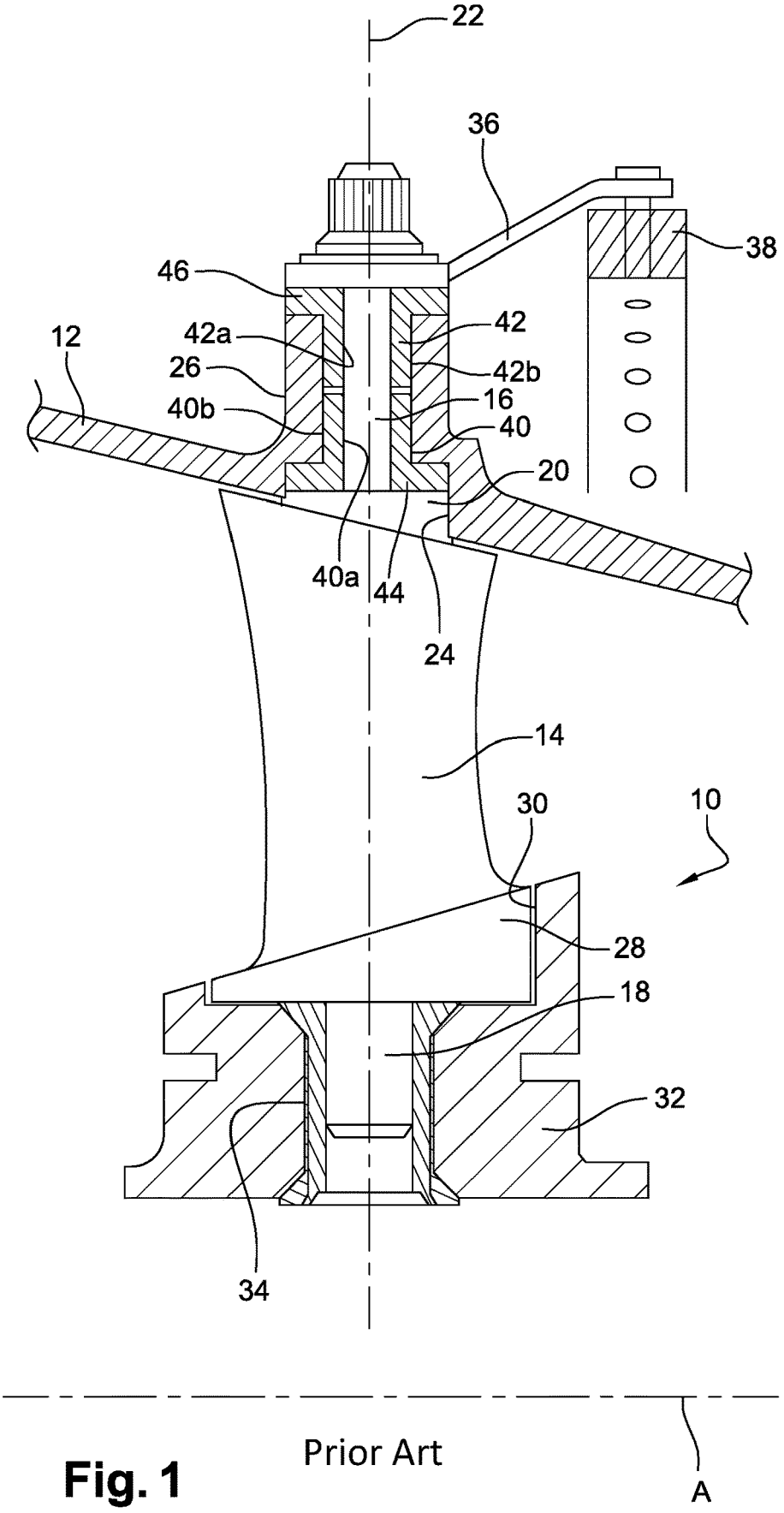
Prior Art Fig. 1
FIG. 1 is a schematic half-view of a stage of variable-pitch vanes according to the prior art.

FIG. 1 shows the prior art of the invention, which figure schematically shows, in an axial cross section, part of a stage 10 of variable-pitch vanes.

This stage 10 of vanes forms part of a high-pressure compressor of a turbine engine, in particular an aircraft turbine engine, that comprises a succession of stages or cascades of variable-pitch stator vanes 10 and stages or cascades of rotor blades.

Each stage comprises an annular row of vanes 10 supported by a stator casing 12, which surrounds the vanes 10.

Each vane 10 comprises a blade 14 and a cylindrical pivot 16, 18 at each of its radial ends.

The radially external pivot 16 is connected to the blade by a disc or a "plate" 20 that extends perpendicularly to the axis 22 of the vane in a corresponding housing 24 of the casing 12. The external pivot 16 extends inside a chamber 26 of the casing 12, which passes radially through the casing 12 and emerges at its radially internal end in the housing 24.

The radially internal pivot 18 is connected to the blade 14 by a disc or a "plate" 28 that extends perpendicularly to the axis 22 of the vane in a corresponding housing 30 of a casing ring 32. The internal pivot 18 extends inside an opening 34 in the casing 12, which passes radially through the casing and emerges at its radially internal end in the housing 30.

The external pivot 16 of each vane 14 is connected at its radially external end to an end of a lever 36, the opposite end of which is connected to a control ring 38, which surrounds the casing 12 and is connected to actuation means (not shown) that allow it to rotate in one direction or in the other direction about the longitudinal axis of the casing 12 in order to drive the vanes 10 of a stage about their axes 22.

The vanes 14 can rotate about their axes 22 between a full closed position and a full open position.

In the full closed position, the blades 18 of the vanes are inclined relative to the longitudinal axis of the turbine engine and together define a minimum cross section of airflow in the duct. The vanes 10 are brought to this position when the turbine engine is at low speed or idling, the airflow flowing in the compressor then having a minimum value.

In the full open position, the blades 14 of the vanes extend substantially in parallel with the axis of the turbine engine so that the cross section of airflow between the blades is maximal. The vanes 10 are brought to this position when the turbine engine is at full throttle, the airflow flowing in the compressor then having a maximum value.

The external pivot 16 of each vane 10 is centred and guided in the corresponding chamber 26 by two cylindrical bushings 40, 42. A first bushing 40 is mounted around a radially internal part of the pivot 16 and comprises an internal cylindrical surface 40*a* interacting with the external cylindrical surface of the pivot 16, and an external cylindrical surface 40*b* interacting with the internal cylindrical surface of the chamber 26. The first bushing 40 comprises, at its radially internal end, an external annular rim 44 interposed between the plate 20 and the bottom of the housing 24.

A second bushing 42 is mounted around a radially external part of the pivot 16 and comprises an internal cylindrical surface 42*a* interacting with the external cylindrical surface of the pivot 16, and an external cylindrical surface 42*b* interacting with the internal cylindrical surface of the chamber 26. The second bushing 42 comprises, at its radially external end, an external annular rim 46 interposed between the free radially external end of the chamber 26 and the aforementioned end of the lever 36.

This technology has sealing problems, as previously mentioned, that are solved by the invention.

Figure 2A:
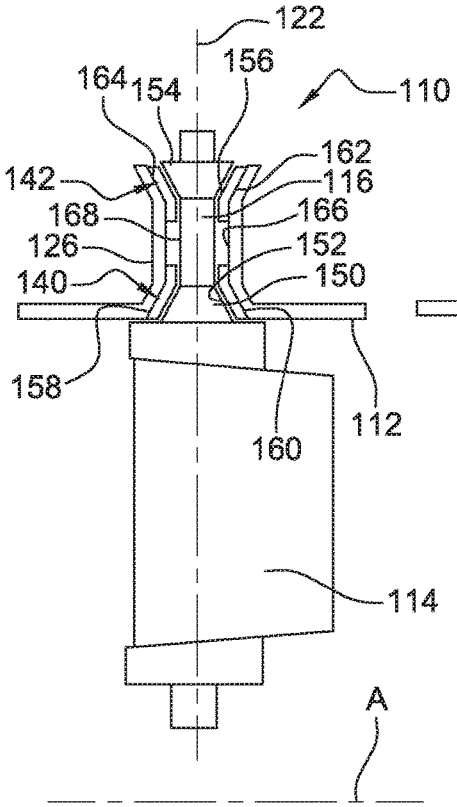
FIGS. 2*a* to 2*c*. are schematic half-views of a stage of variable-pitch vanes according to the invention.

FIG. 2*a* and following show embodiments of the invention.

Figure 2B:
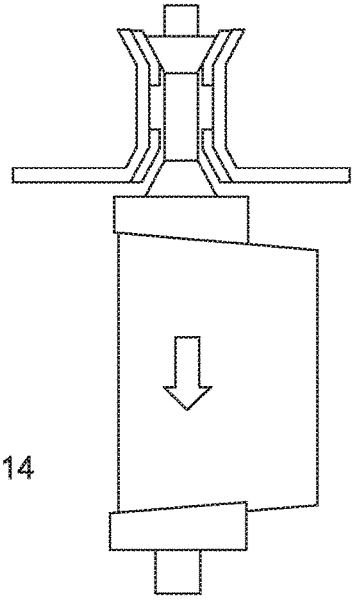

The vanes 110 of the stage of FIGS. 2*a* to 2*c* differ to those previously described with reference to FIG. 1, basically with respect to their external pivots 116, the bushings 140, 142 for guiding these pivots and with respect to the chambers 126 of the casing 112.

The external pivot 116 of each vane 110 in this case comprises:

a first radially internal frusto-conical surface 150, the cone angle of which is radially flared inwards and which is designed to interact with an internal frusto-conical surface 152 of the first substantially frusto-conical bushing 140; and a second radially external frusto-conical surface 154, the cone angle of which is radially flared outwards and which is designed to interact with an internal frusto-conical surface 156 of the second substantially frusto-conical bushing 142.

Figure 3A:
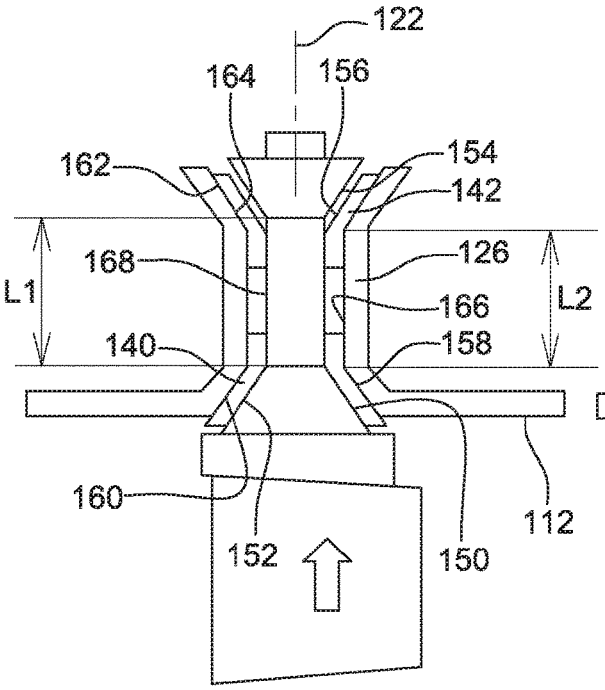
FIGS. 3*a* and 3*b* are schematic half-views of a stage of variable-pitch vanes according to the invention and respectively show the cases without and with wear of the bushings for guiding the external pivots of the vanes.

The first bushing 140 comprises an external frusto-conical surface 158 designed to interact with an internal frusto-conical surface 160 of the chamber 126 of the casing, and the second bushing 142 comprises an external frusto-conical surface 162 designed to interact with an internal frusto-conical surface 164 of the chamber 126 of the casing (FIG. 3*a*).

The chamber 126 comprises an internal cylindrical surface 166 extending between the radially external end of the surface 160 and the radially internal end of the surface 164.

Similarly, the pivot 116 comprises an external cylindrical surface 168 extending between the radially external end of the surface 150 and the radially internal end of the surface 154.

The first bushing 140 comprises, at its radially external end, a cylindrical rim, the external cylindrical surface of which interacts with the internal cylindrical surface 166 of the chamber 126. The second bushing 142 comprises, at its radially internal end, a cylindrical rim, the external cylindrical surface of which interacts with the internal cylindrical surface 166 of the chamber 126.

In the example shown, and advantageously, the length (or radial distance) L1 of the external cylindrical surface 168 of the pivot 116 is greater than the length L2 of the internal cylindrical surface 166 of the chamber 126, such that an axial clearance in relation to the axis 122 or a radial clearance in relation to the axis A are provided upon mounting between the pivot 116 and the bushings 140, 142.

When the pressures between the inside and the outside of the casing 112 are balanced, the vanes 110 can be in the position shown in FIG. 2*a*. When the pressure on the external plate of the vane is greater than the pressure on the internal plate, the vanes are radially stressed outwards and come into abutment, via their frusto-conical surfaces, on the first bushings 140 (FIG. 2*b*). By contrast, when the pressure on the internal plate of the vane is greater than the pressure on its external plate, the vanes are radially stressed inwards and come into abutment, via their frusto-conical surfaces, on the second bushings 142 (FIG. 2*c*).

Figure 2C:
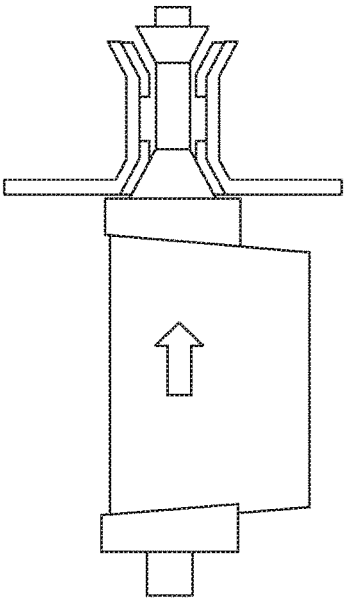
Figure 3B:
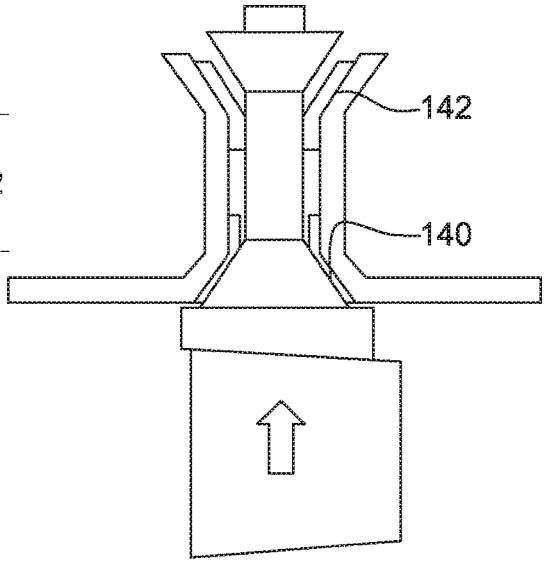

FIG. 3*a* is similar to FIG. 2*c* and FIG. 3*b* shows the result of wear of a bushing, in this case the first bushing 140. When the bushing 140 is worn, its radial thickness (relative to the axis 22) decreases.

When the pressure on the external plate of the vane is greater than the pressure on its internal plate, the vanes are radially stressed outwards and come into abutment, via their frusto-conical surfaces, on the first bushings, even if they are worn (FIG. 3*b*). The invention thus allows the seal to be maintained between the pivot and the casing when the bushings for guiding this pivot are worn. As a result of the wear of the bushing 140, the vane may be caused to move outwards more radially, compared with when the bushing is not worn, as can be seen in the drawings.

FIG. 3*b* shows the specific case of "radial" wear of the first bushing, i.e. this bushing is worn over its entire periphery. The case in which the second bushing is worn is also conceivable. Furthermore, "axial" or unilateral wear is also possible, regardless of whether it is the first and/or the second bushing. This type of wear is characterised by a localised axial portion of wear of the bushing. Depending on the pressure in the duct of the compressor, the vane may be caused to undergo a radially outwards movement or even a tilt that is expressed by an incline of the pivot of the vane relative to the chamber of the casing. Even in these cases, the seal is provided.

Depending on the state of wear of the bushings, it is conceivable, for example during a maintenance operation, to retighten the second bushing on the pivot of the vane in order to compensate for this wear. The second bushing can be equipped with anti-rotation means to prevent it from becoming loose during operation.

Figure 4A:
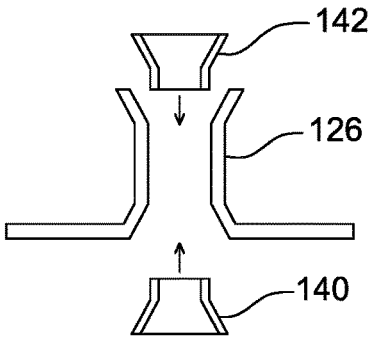
FIGS. 4*a* to 4*c* are schematic half-views of a stage of variable-pitch vanes according to the invention and show steps of mounting this stage.
Figure 4B:
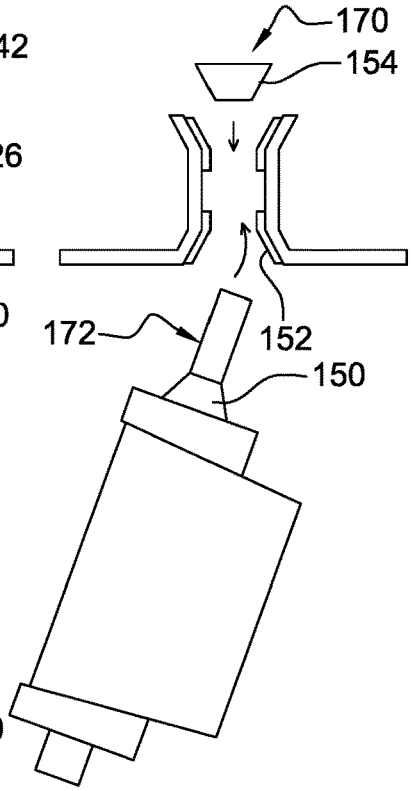
Figure 4C:
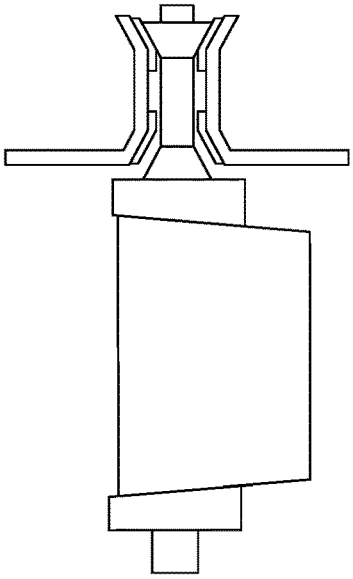

FIGS. 4*a* to 4*c* show steps of mounting a stage according to the invention.

During a first step, shown in FIG. 4*a*, the bushings 140, 142 are mounted in the chamber 126 of the casing 112. The first bushing 140 is mounted in a radially internal part of the chamber, by radial translation from the inside to the outside, so that its cylindrical rim is inserted at the internal cylindrical surface of the chamber 126. The second bushing 142 is mounted in a radially external part of the chamber, by radial translation from the outside to the inside, so that its cylindrical rim is inserted at the internal cylindrical surface of the chamber 26.

The vane 110 is then positioned in the casing and its pivot 116 is inserted into the chamber, by radially moving said pivot from the inside to the outside. It can be seen in FIG. 4*b* that the pivot 116 is provided with its first external frusto-conical surface 150 but is devoid of its second external frusto-conical surface 154.

The first frusto-conical surface 150 of the pivot 116 is defined by a radially internal frusto-conical part of the pivot, which part is integrally formed with the pivot. By contrast, the second frusto-conical surface 152 of the pivot is defined by an internally threaded ring 170 designed to be screwed onto an externally threaded radially external part 172 of the pivot.

The external pivot 116 of the vane is inserted into the chamber 126 until the first frusto-conical surface 150 of the pivot comes into abutment on the internal frusto-conical surface 152 of the first bushing 140 (FIG. 4*b*).

The ring 170 is then placed on the pivot and is screwed onto the externally threaded part 172 of the pivot. In the screwed position, the second frusto-conical surface defined by the ring is radially spaced apart from the internal frusto-conical surface of the second bushing.

Figure 5A:
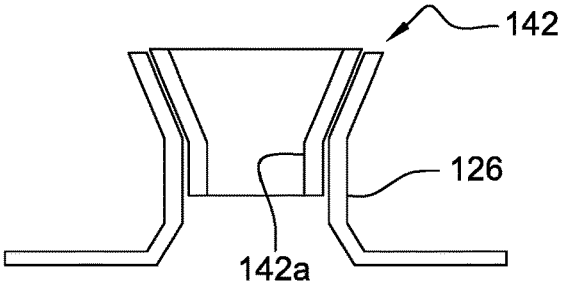
FIGS. 5*a* to 5*c* are schematic half-views of bushings for the stage according to the invention.
Figure 5B:
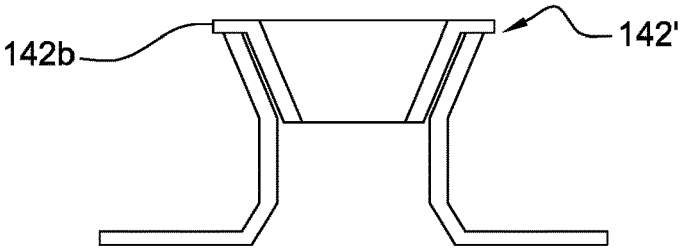
Figure 5C:
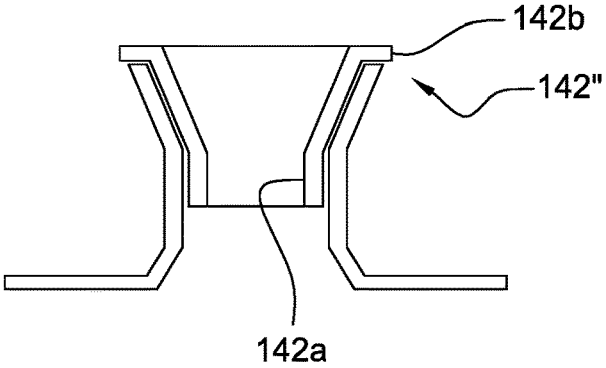

FIGS. 5*a* to 5*c* show variations of bushings 142 for the stage according to the invention, which variations are applicable to the bushings 140.

The bushing 142 of FIG. 5*a* is similar to the previously described bushing and comprises a cylindrical rim 142*a* at one of its longitudinal ends. It is understood that it is the interaction between the frusto-conical portion of the bushing 142 and the frusto-conical surface of the chamber 126 that will ensure that the bushing is retained inside the chamber (along the axis of the bushing).

The bushing 142' of FIG. 5*b* comprises an external annular rim 142*b* at one of its longitudinal ends that is intended to come into abutment on the free radially external end of the chamber 126, for example, as is the case for the bushing of FIG. 1. This rim 142*b* can interact with the chamber to ensure that the bushing is retained inside the chamber (along the axis of the bushing) and to provide possible contact between the chamber of the casing and the control lever of the vane.

The bushing 142" of FIG. 5*c* comprises an external annular rim 142*b* at one of its longitudinal ends and a cylindrical rim 142*a* at its opposite longitudinal end.

The invention claimed is:

1. A stage of variable-pitch vanes for a turbine engine, comprising an annular casing with an axis of revolution and an annular row of vanes extending about said axis and inside the casing, each vane comprising a substantially radial blade comprising a radially internal cylindrical pivot and a radially external pivot, the radially external pivot of each vane being mounted in a radial chamber of the casing and being centered and guided in the chamber, wherein the radially external pivot of each vane comprises:

a first radially internal frusto-conical surface having a first cone angle radially flared inwards and configured to engage a first internal frusto-conical surface of a first substantially frusto-conical bushing, said first frusto-conical bushing comprising an external frusto-conical surface designed to interact with an internal frusto-conical surface of the chamber of the casing; and a second radially external frusto-conical surface having a second cone angle flared outwards configured to engage a second internal frusto-conical surface of a second substantially frusto-conical bushing, said second bushing comprising an external frusto-conical surface designed to interact with an internal frusto-conical surface of the chamber of the casing.

2. The stage according to claim 1, wherein said first radially internal frusto-conical surface and said second radially external frusto-conical surface are connected together by a cylindrical surface of the radially external pivot.

3. The stage according to claim 1, wherein each of said first and second frusto-conical bushings comprises a cylindrical or radial rim.

4. The stage according to claim 1, wherein the closest radial distance between said first and second frusto-conical surfaces of the radially external pivot is greater than a length of an internal cylindrical surface of the radial chamber.

5. The stage according to claim 1, wherein the first frusto-conical surface of the radially external pivot is defined by a radially internal frusto-conical part of the radially external pivot, which part is integrally formed with the radially external pivot, and the second frusto-conical surface of the radially external pivot is defined by an internally threaded ring configured to threadedly engage an externally threaded radially external frusto-conical part of the radially external pivot.

6. A method for mounting a stage according to claim 5, wherein said method comprises the following steps, including, for each vane:

mounting said first and second bushings in the chamber of the casing;

positioning the vane in the casing and inserting the radially external pivot of that vane into a corresponding chamber of the casing, by radially moving said pivot from the inside to the outside, until the first frusto-conical surface of the pivot comes into abutment on the internal frusto-conical surface of the first bushing;

placing the ring on the pivot and screwing the ring onto the externally threaded part of the pivot, until a desired distance is obtained between said first and second frusto-conical surfaces.

7. A method according to claim 6, wherein, after screwing, the second frusto-conical surface defined by the ring is radially spaced apart from the internal frusto-conical surface of the second bushing.

8. A turbine engine for aircraft, comprising at least one stage according to claim 1.

* * * * *